US007862159B2

(12) United States Patent
Tatsumi et al.

(10) Patent No.: US 7,862,159 B2
(45) Date of Patent: Jan. 4, 2011

(54) INK JET RECORDING HEAD AND RECORDING APPARATUS

(75) Inventors: Junji Tatsumi, Kawasaki (JP); Hideo Saikawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 12/246,886

(22) Filed: Oct. 7, 2008

(65) Prior Publication Data

US 2009/0102893 A1 Apr. 23, 2009

(30) Foreign Application Priority Data

Oct. 10, 2007 (JP) ..... 2007-264558

(51) Int. Cl.
*B41J 2/05* (2006.01)

(52) U.S. Cl. ..... 347/65

(58) Field of Classification Search ..... 347/65
See application file for complete search history.

(56) References Cited

U.S. PATENT DOCUMENTS 6,652,702 B2 11/2003 Miyazaki et al.

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

An ink jet recording head includes a recording element substrate including an ejection outlet array consisting of a plurality of arranged ejection outlets for ejecting ink, a plurality of heat generating elements, provided correspondingly to the ejection outlets, for generating thermal energy for ejecting the ink, and a supply port, formed along the ejection outlet array in an elongated hole-like shape, for supplying the ink to the ejection outlets; and a supporting member, having a supply flow passage communicating with the supply port, for supporting the recording element substrate. The supporting member is provided with at least two beams each extending over an opening of the supply flow passage in a widthwise direction of the supply flow passage and having a width W with respect to a longitudinal direction of the supply flow passage. At least two beams described above are disposed within a range from a center of the supply flow passage with respect to the longitudinal direction toward both longitudinal end sides of the supply flow passage by 2.5 W for each of the end sides and are spaced 2 mm or more apart.

5 Claims, 15 Drawing Sheets

INK JET RECORDING HEAD AND RECORDING APPARATUS

FIELD OF THE INVENTION AND RELATED ART

The present invention relates to an ink jet recording head for ejecting ink and a recording apparatus for effecting recording on a recording material by using the ink jet recording head.

Conventional recording apparatuses for effecting recording on a recording material such as paper or an OHP (overhead projector) sheet have been proposed in various forms such that recording heads adapted to various recording methods are mounted. These recording heads are of a wire dot type, a thermal type, a thermal transfer type, an ink jet type, and the like. Particularly, the ink jet type recording head directly ejects ink droplets onto the recording material, thus having advantages of a relatively low running cost, low noise, etc. Of this ink jet type recording head, a recording head of a recording type using electrothermal transducer elements is adapted to high-density image recording or high-speed recording and is put into practical use.

In an ink jet recording apparatus employing such a recording type using the electrothermal transducer elements, an ink jet recording head has been used representatively as described in U.S. Pat. No. 6,652,702. FIG. 16 is a sectional view showing a constitution of the ink jet recording head disclosed in U.S. Pat. No. 6,652,702.

As shown in FIG. 16, at a surface of a recording element substrate 104, ejection energy generating elements 105 consisting of electrothermal transducer elements and recording liquid supply ports 106 are provided. At the surface of the recording element substrate 103 where the ejection energy generating elements 105 are formed, correspondingly to each of the recording liquid supply ports 106, two arrays of ejection outlets 104*a* are opened and an ejection outlet plate includes the two arrays of ejection outlets as a pair. In the constitution shown in FIG. 16, three pairs of ejection outlet arrays are provided.

The recording element substrate 103 is supported by a supporting member 101 having recording liquid supply flow passages 101*a*. In the supporting member 101, the recording liquid supply flow passages 101*a* are disposed through partition walls 101*b* at positions corresponding to those of the above-described three pairs of the ejection outlet arrays.

In recent years, by taking the advantages of the ink jet recording type, the ink jet recording apparatus has been used in a field of a so-called large-size printing. The large-size printing refers to printing (recording) for a relatively large size (recording area) such as a large-size poster principally for, e.g., an event or a presentation and there is also a recording apparatus capable of effecting recording on a recording material having a maximum width of about 2 m.

With respect to such a large-size printing, there are the following demands on the recording apparatus.

(1) The recording area of the recording material is large and therefore high-speed recording is desired.

(2) In the large-size printing, an image to be recorded on the recording material is continuously formed over the recording area, so that in the case of interrupting a recording operation during the recording, the image to be recorded is changed in color. For this reason, in the large-size printing, at least in the recording area of the same recording material, the recording is desired to be effected continuously while the interruption of the recording operation is avoided.

In order to meet the above-described demands (1) and (2), first, the high-speed recording can be achieved by increasing the number of the electrothermal transducer elements as the heat generating elements. On the other hand, with respect to the continuous recording in the same recording material, control of heat generated by drive of the electrothermal transducer elements is an important factor.

In the recording type using the electrothermal transducer elements, a recording signal is applied to the electrothermal transducer elements as electric energy. As a result, the electrothermal transducer elements are abruptly increased in temperature to impart thermal energy to ink on the electrothermal transducer elements, so that ink droplets are ejected from ejection outlets by bubble pressure generated by phase change of the ink. At this time, the applied electric energy is larger than energy, released to the outside, such as kinetic energy or the like of the ejected ink droplets. Therefore, excessive energy corresponding to a difference between the electric energy and the released energy is gradually accumulated in the recording head as heat to increase a temperature of the recording head itself. In the case where the recording operation is continuously performed in the ink jet recording apparatus, the recording head is successively subjected to heating before the accumulated heat is released to the outside, so that the temperature of the recording head is increased. When the temperature exceeds a predetermined temperature range, an ink ejection state is started to be unstable, so that a defect can occur in a recording image. For this reason, ordinarily, the recording operation is stopped before the temperature exceeds the predetermined temperature range and then control is effected so as to suppress the temperature rise of the recording head.

Therefore, factors to be taken into consideration at the time when the recording is continuously performed are that heat accumulated in the recording element substrate in which the electrothermal transducer elements are disposed is quickly dissipated and that the thermal energy during drive is suppressed.

An influence of the temperature of the ink jet recording head on the ejection state will be described with reference to FIGS. 17(*a*) and 17(*b*). FIG. 17(*a*) is a schematic view showing a bubble generation state at normal temperature when the thermal energy is applied to the electrothermal transducer elements. FIG. 17(*b*) is a schematic view showing a bubble generation state at high temperature when the thermal energy is applied to the electrothermal transducer elements.

As shown in FIG. 17(*a*), a maximum generated bubble 381A at normal temperature reaches an intermediate portion of an ink flow passage 332 and thereafter collapses. On the other hand, as shown in FIG. 17(*b*), a size of a maximum generated bubble 381B at high temperature is extremely larger than that of the maximum generated bubble 381A at normal temperature, so that the maximum generated bubble 381B passes through the ink flow passage 332 and considerably enters a common liquid chamber 333. As a result, a time required for bubble collapse is increased, so that a time until the ink is filled in a bubble generation chamber 331 is increased. In the case where the electric energy is applied to a subsequent electrothermal transducer element 304 before the ink is filled in the bubble generation chamber 331, improper bubble generation is caused to occur and thus ejection of the ink is not performed normally, so that a size of an ink droplet ejected from ejection outlets can be nonuniform. Further, in such a case, the ink droplet can be ejected in the form of a plurality of split ink droplets, not a single ink droplet. In the worst case, ejection itself cannot be performed. As a result, depending on a recording area for a recorded image, an image density varies or fog occurs, so that there is a possibility of an occurrence of an image which does not reach a usable quality. For that reason, in the case where the temperature of the recording head exceeds its limit temperature, an ejection frequency is lowered or a rest period is provided during the recording operation. Further, as desired, the recording operation is temporarily stopped and the temperature of the recording head is lowered.

However, in order to realize the high-speed recording operation, the number of the electrothermal transducer elements is liable to increase as described above and a degree of integration of the electrothermal transducer elements is also increased. For this reason, in the conventional ink jet recording head, a total amount of heat generation is far larger than an amount of heat release per unit time, so that it was difficult to realize continuous recording for a long time.

Therefore, in the recording apparatuses for that purpose, most of the recording apparatuses are based on the premise that the image quality is lowered to some extent, so that the image quality and the high-speed recording operation have not been realized compatibly.

SUMMARY OF THE INVENTION

The present invention has been accomplished for solving the above-described problems. A principal object of the present invention is to provide an ink jet recording head and a recording apparatus which are capable of achieving high-quality and high-speed recording by promoting control of heat of the ink jet recording head.

According to an aspect of the present invention, there is provided an ink jet recording head comprising:

a recording element substrate comprising an ejection outlet array consisting of a plurality of arranged ejection outlets for ejecting ink; a plurality of heat generating elements, provided correspondingly to the ejection outlets, for generating thermal energy for ejecting the ink; and a supply port, formed along the ejection outlet array in an elongated hole-like shape, for supplying the ink to the ejection outlets; and a supporting member, having a supply flow passage communicating with the supply port, for supporting the recording element substrate, wherein the supporting member is provided with at least two beams each extending over an opening of the supply flow passage in a widthwise direction of the supply flow passage and having a width W with respect to a longitudinal direction of the supply flow passage, and wherein the at least two beams are disposed within a range from a center of the supply flow passage with respect to the longitudinal direction toward both longitudinal end sides of the supply flow passage by 2.5 W for each of the end sides and are spaced 2 mm or more apart.

According to the present invention, by the beams provided to the supporting member for supporting the recording element substrate, it is possible to quickly release heat accumulated in the recording element substrate. For this reason, according to a recording apparatus of the present invention, even in the case where a continuous recording operation is performed, temperature rise of the recording element substrate is suppressed, so that it is possible to improve a recording speed without lowering a recording quality.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
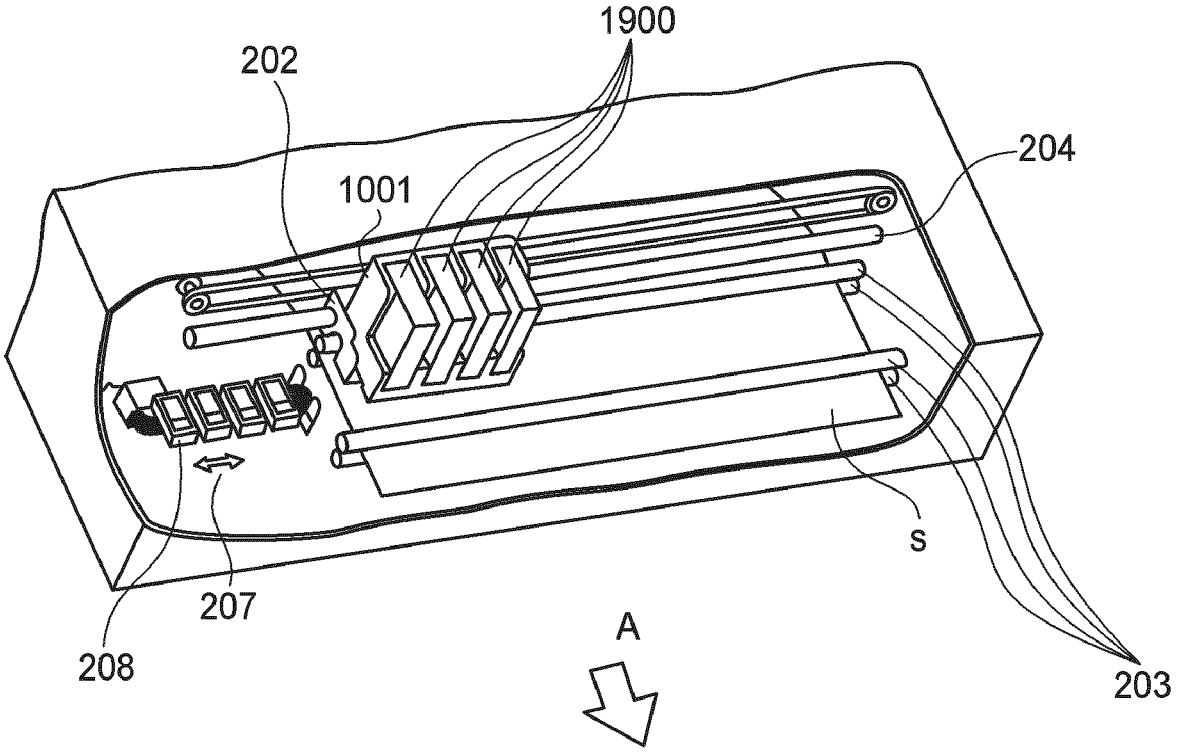
FIG. 1 is a perspective view schematically showing an example of a constitution of an ink jet recording apparatus according to an embodiment of the present invention.

Hereinbelow, embodiments of the present invention will be described with reference to the drawings.

First, in order to prevent the ejection defect described above with no interruption of the recording operation, the beams are provided to the supporting member including the supply flow passages provided correspondingly to the elongated hole-like supply ports provided to the recording element substrate so that the beams are disposed perpendicularly to the supply flow passages with respect to the longitudinal direction of the supply flow passages provided to the supporting member. Release of heat accumulated in the recording head, particularly at a central portion of a principal surface of the recording material, by these beams was considered. As a result, by providing the beams to the supporting member including the supply flow passages, it was possible to lower a maximum temperature of the electrothermal transducer elements during the drive of the electrothermal transducer elements with reliability. In addition, it was also found that an increase in the number of beams to be provided over the supply flow passages is not necessarily correlated with a lowering in maximum temperature of the recording head. This may be attributable to the following background.

That is, a continuous recording time in the large-size printing is longer than a recording time (e.g., one minute) estimated with respect to a conventional consumer ink jet recording apparatus. Further, the recording head is constituted so that the electrothermal transducer elements are integrated at a relatively high density in order to increase the recording speed.

In such an environment, in the first place, it is difficult to use the recording apparatus at a limit temperature (e.g., 70° C.) set in view of a predetermined margin, so that the recording apparatus has to be based on the premise that the recording apparatus is used for a long time at high temperature to some extent.

A temperature characteristic of the recording element substrate driven in such an environment will be described. FIGS. 10 to 13 are graphs each showing a temperature characteristic including data calculated by simulation when the electrothermal transducer elements are driven continuously for one minute. FIG. 11 shows a temperature characteristic in the case of no beam, and FIG. 12 shows a temperature characteristic in the case where a single beam is disposed at a center of a supply flow passage with respect to a longitudinal direction of the supply flow passage. FIG. 13 shows a temperature characteristic in the case where two beams are equidistantly disposed with respect to the longitudinal direction of the supply flow passage.

When FIG. 11 and FIGS. 12 and 13 are compared, i.e., when the case of the absence of beam(s) and the case of the presence of beam are compared, a maximum temperature of the recording element substrate is lowered in each of constitution of FIGS. 11, 12 and 13 but the maximum temperature in the constitution of FIG. 13 is higher than that in the constitution of FIG. 12.

Ordinarily, when only the heat release is considered, a heat release performance is improved in the case where a dimension of the beam parallel to the longitudinal direction of the supply flow passage, i.e., a width dimension of the beam is relatively large and the number of beams is increased, so that such a case is considered to be advantageous for heat release. However, as shown in FIGS. 12 and 13, such a characteristic is not actually obtained. Further, from the viewpoint of refill performance representing an ink supply ability, it is desirable that the width of the beam is decreased as narrow as possible and the number of beams is decreased as small as possible.

In view of these circumstances, apart from the concept that the maximum temperature of the recording element substrate is lowered, the beam width, the number of beams and a layout of the beams were studied in combination, with the result that considerable improvement in performance has been found.

That is, the supporting member (first plate) in this embodiment is provided with two beams, each extending over an opening of the supply flow passage in a widthwise (short side) direction of the supply flow passage and having a width W with respect to the longitudinal direction of the supply flow passage. These two beams are spaced 2 mm or more apart with respect to the longitudinal direction of the supply flow passage. The beams are desired to be disposed in the neighborhood of a center of the supply flow passage with respect to the longitudinal direction of the supply flow passage but a temperature of the beam portion is high, so that the beams are spaced on the basis of the concept that the high-temperature portion is dispersed.

According to the above constitution, even in the case where the beam width is relatively narrow and the number of beams is small, it is possible to obtain a desired heat release characteristic. That is, according to the constitution of this embodiment, it is possible to improve the recording speed without sacrificing the refill characteristic and without causing a lowering in recording quality.

The present invention is also applied in the case where each beam is disposed at a position exceeding a range from a center of the supply flow passage with respect to the longitudinal direction toward a longitudinal end of the supply flow passage by 2.5 times the beam width. In such a case, it is possible to provide the beams in consideration of the viewpoint of refill as described later. Further, in the case where the spacing (distance) between the beams is less than 2 mm, the refill performance is undesirably lowered.

Figure 10:
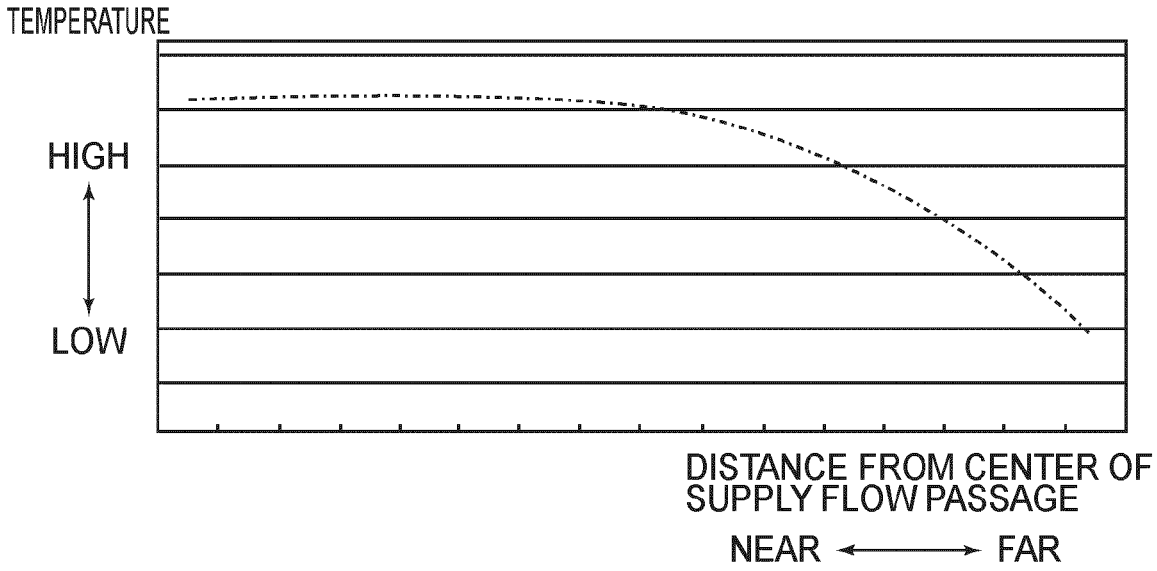
FIG. 10 is a graph showing a temperature characteristic in the case where two beams are disposed at positions in the embodiment.
Figure 11:
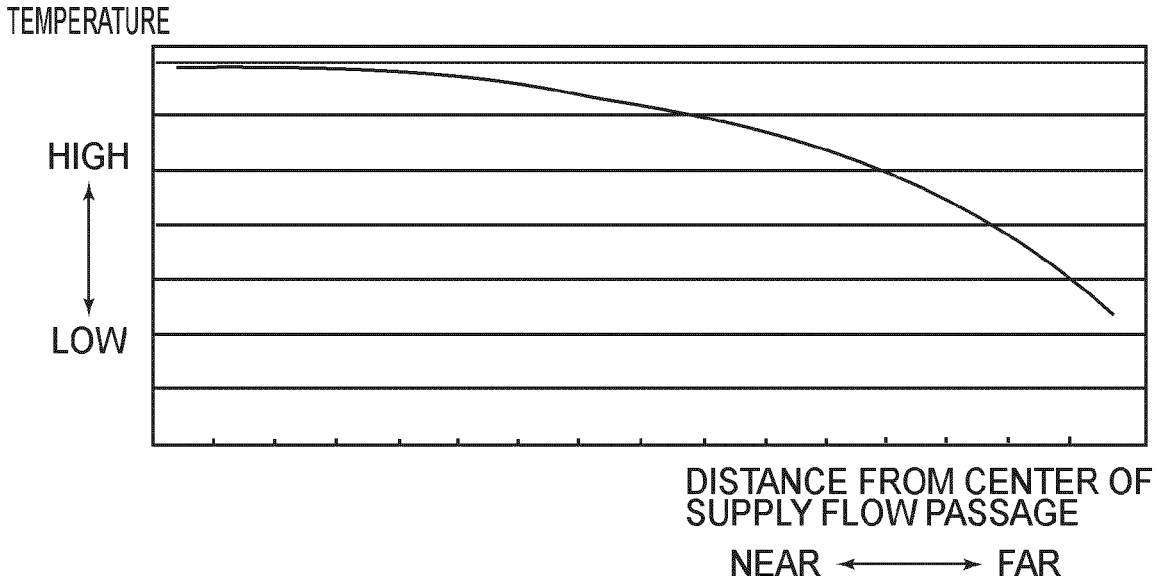
FIG. 11 is a graph showing a temperature characteristic in the case of no beam.
Figure 12:
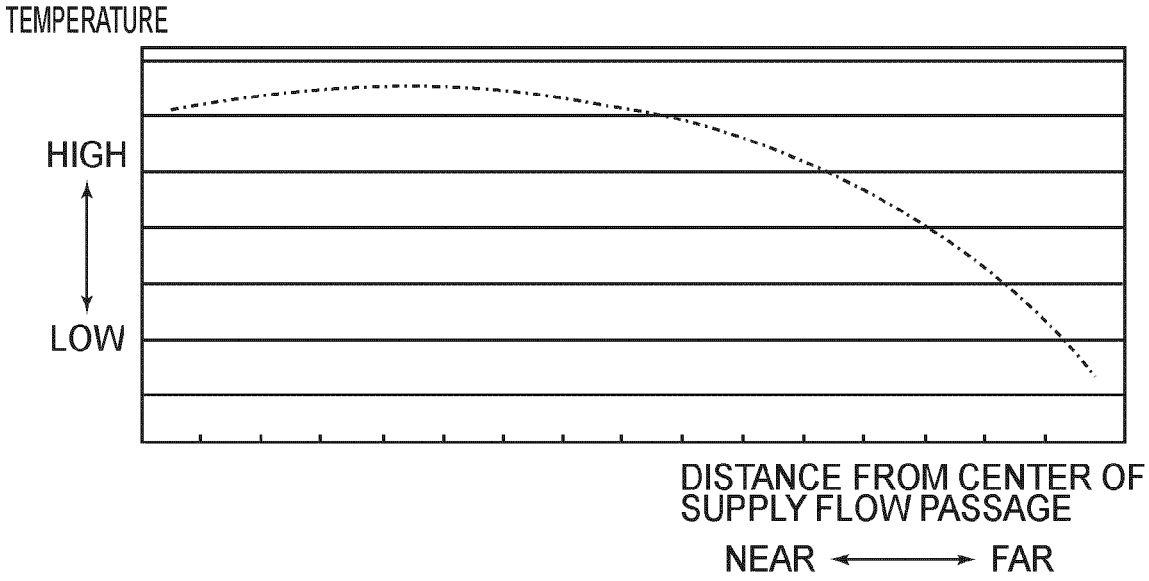
FIG. 12 is a graph showing a temperature characteristic in the case where a single beam is disposed at a center position of a supply flow passage with respect to a longitudinal direction of the supply flow passage.
Figure 13:
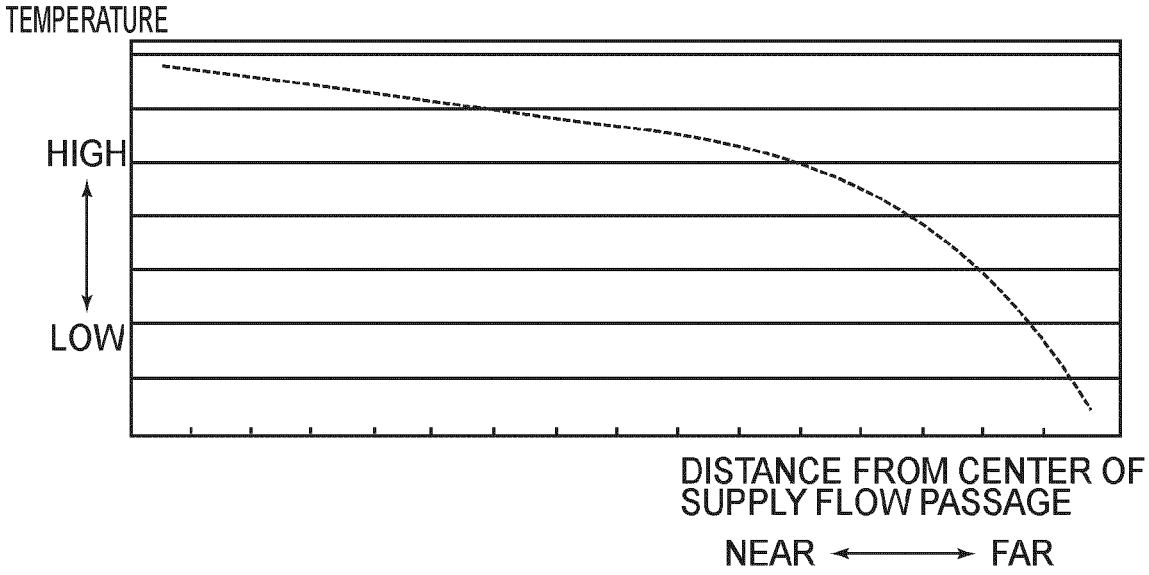
FIG. 13 is a graph showing a temperature characteristic in the case where two beams are equidistantly disposed at positions of a supply flow passage with respect to a longitudinal direction of the supply flow passage.

FIG. 10 is a graph showing a temperature characteristic including data calculated by simulation when the electrothermal transducer elements are driven continuously for one minute, similarly as in the cases of FIGS. 11 to 13. Specifically, FIG. 10 shows a temperature characteristic of an ink jet recording head in such an embodiment that a center line of each of two beams (each having a width of 2 mm) is disposed at a position spaced 2 mm apart from the center of the supply flow passage with respect to the longitudinal direction of the supply flow passage, i.e., the spacing between the two beams is 2 mm. Other constitutions and conditions of this embodiment are the same as those in the embodiments shown in FIGS. 11 to 13. When FIG. 10 and FIGS. 12 and 13 are compared, it is clear that the maximum temperature of the ink jet recording head of the embodiment shown in FIG. 10 is remarkably lowered. In addition, such a characteristic that a curve portion representing the maximum temperature is close to flat is shown, so that thermal energy is efficiently distributed.

According to such a constitution, it is possible to effect predictive control of a driving condition based on a change in temperature with accuracy. When a longitudinal dimension of the supply flow passage is further increased, the number of beams to be provided at the central portion of the supply flow passage may be increased as desired but also in such a case, a similar effect can be achieved by employing the above-described constitution of the present invention.

The above-described embodiment of the present invention will be described more specifically with reference to the drawings. FIG. 1 to FIG. 6 are schematic views for illustrating the ink jet recording apparatus and its constituents such as the ink container and the recording head. The respective constituents will be described with reference to these figures.

FIG. 1 is a perspective view showing a schematic structure of the ink jet recording apparatus of this embodiment and an operation of the recording apparatus will be described below.

As shown in FIG. 1, the ink jet recording apparatus repeats reciprocal movement (main scanning) of a recording head 1001 and conveyance (sub-scanning) of a recording material S, such as general-purpose recording paper, special paper or an OHP film, with a predetermined pitch. In synchronism with these movements, ink droplets are selectively ejected from the recording head 1001 to be attached to the recording material S, thus forming a character, a symbol, an image, or the like. Thus, the ink jet recording apparatus is of a serial type.

The ink jet recording apparatus includes an ink container 1900 and the recording head 1001 for ejecting ink supplied from the ink container 1900 depending on recording information. The recording head 1001 is detachably mounted on a carriage 202 which is slidably supported by a guide rail 204 and is reciprocated along the guide rail 204 by a driving portion such as an unshown motor. The recording head 1001 employs a so-called cartridge type, thus having ejection outlet arrays of four types of black, cyan, magenta and yellow, in order to eject inks of different colors. Corresponding to the colors of inks to be ejected from the recording head 1001, the ink containers 1900 of four types of black, cyan, magenta and yellow are independently mounted detachably to the recording head 1001.

The recording material faces an ink ejection surface of the recording head 1001 and is conveyed in an arrow A direction perpendicular to a movement direction of the carriage 202 by a conveyance roller 203 while retaining a distance thereof from the ink ejection surface.

A refreshing unit 207 is disposed in a non-recording area, which is within a reciprocal movement range of the recording head 1001 and is outside of a sheet passing range of the recording material S, so as to face the ink ejection surface of the recording head 1001. The recording head 1001 is subjected to a suction refreshing operation by capping units 208 corresponding to the ejection outlet arrays of four types of black, cyan, magenta and yellow.

Figure 2:
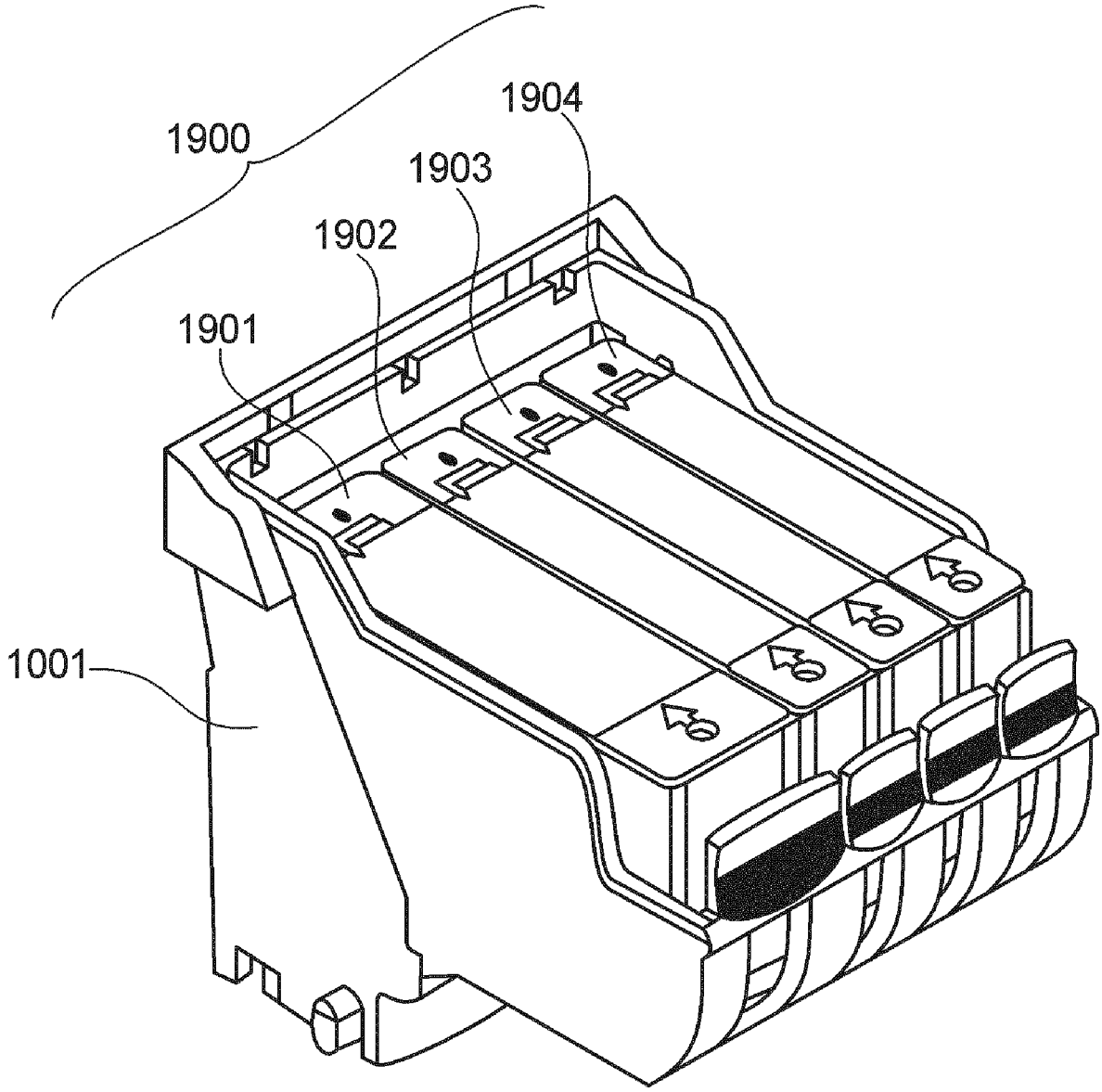
FIG. 2 is a perspective view showing a state in which ink containers are mounted on a recording head in the embodiment of the present invention.

FIG. 2 is a perspective view showing a state in which the ink container 1900 is detachably mounted to the recording head 1001. As shown in FIG. 2, ink containers (1901, 1902, 1903 and 1904) of four types of black, cyan, magenta and yellow are independently mounted detachably to the recording head 1001 in correspondence with the colors of inks to be ejected from the recording head 1001.

Hereinbelow, the recording head 1001 will be described more specifically for each of constituent elements thereof.

[Recording Head]

The recording head 1001 employs a bubble jet method in which recording is effected by using electrothermal transducer elements for generating thermal energy for generating bubbles of ink. In the bubble jet method, the recording head 1001 is of a side shooter type wherein ink is ejected in a direction perpendicular to a principal surface of the electrothermal transducer elements.

Figure 3:
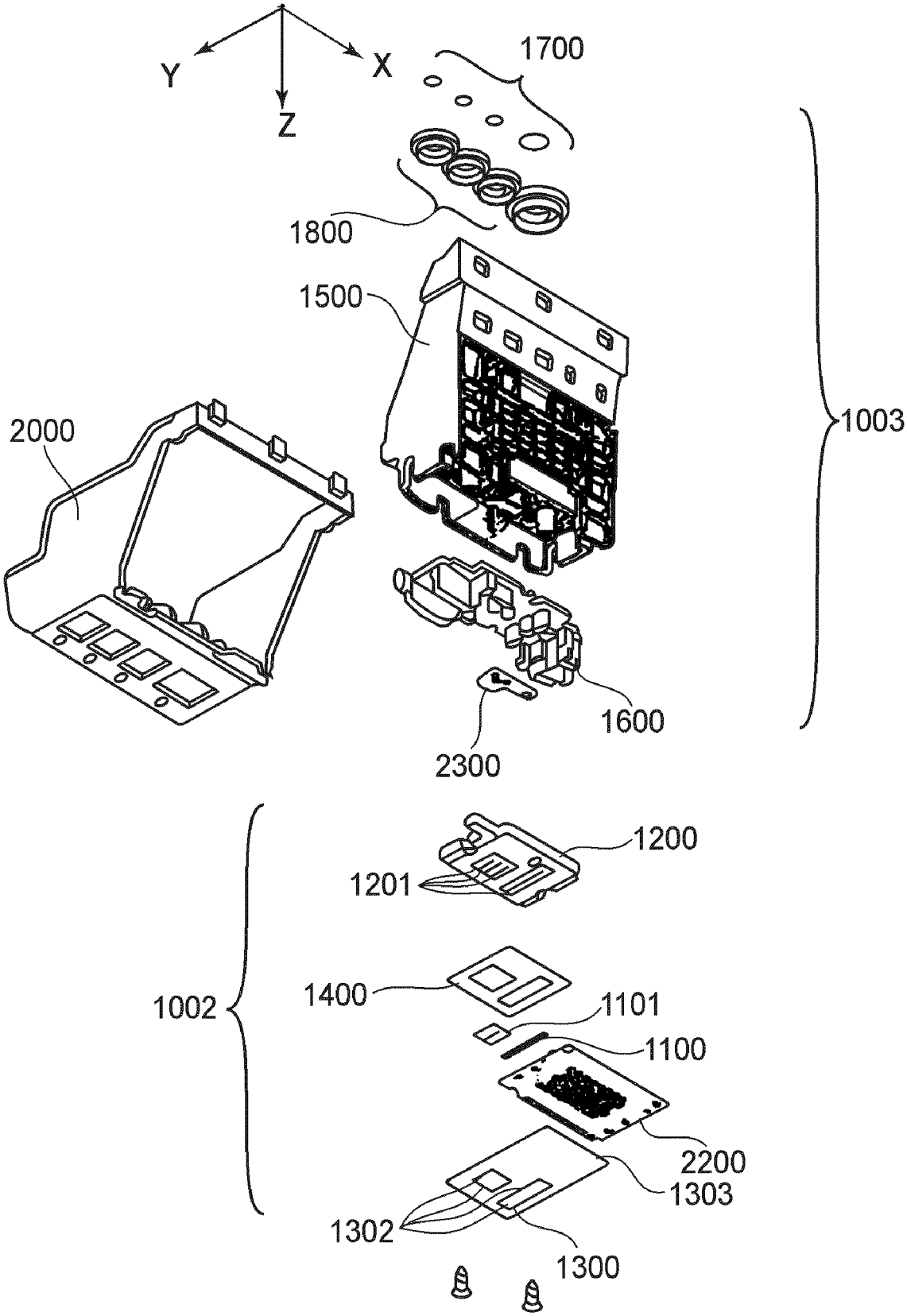
FIG. 3 is an exploded perspective view showing an ink supply unit and a recording element unit.

The recording head 1001 is, as shown in FIG. 3, constituted by a recording element unit 1002, an ink supply unit 1003 and a container holder 2000. The recording element unit 1002 is constituted by including a first recording element substrate 1100, a second recording element substrate 1101 and a first plate 1200 as a supporting member for supporting these recording element substrates 1100 and 1101. The recording element unit 1002 also includes an electric wiring tape 1300, an electric contact substrate 2200, and a second plate 1400. The ink supply unit 1003 is constituted by including an ink supply member 1500, a flow passage-forming member 1600, a joint rubber 2300, a filter 1700, and a sealing rubber 1800.

[Recording Element Unit]

Figure 4:
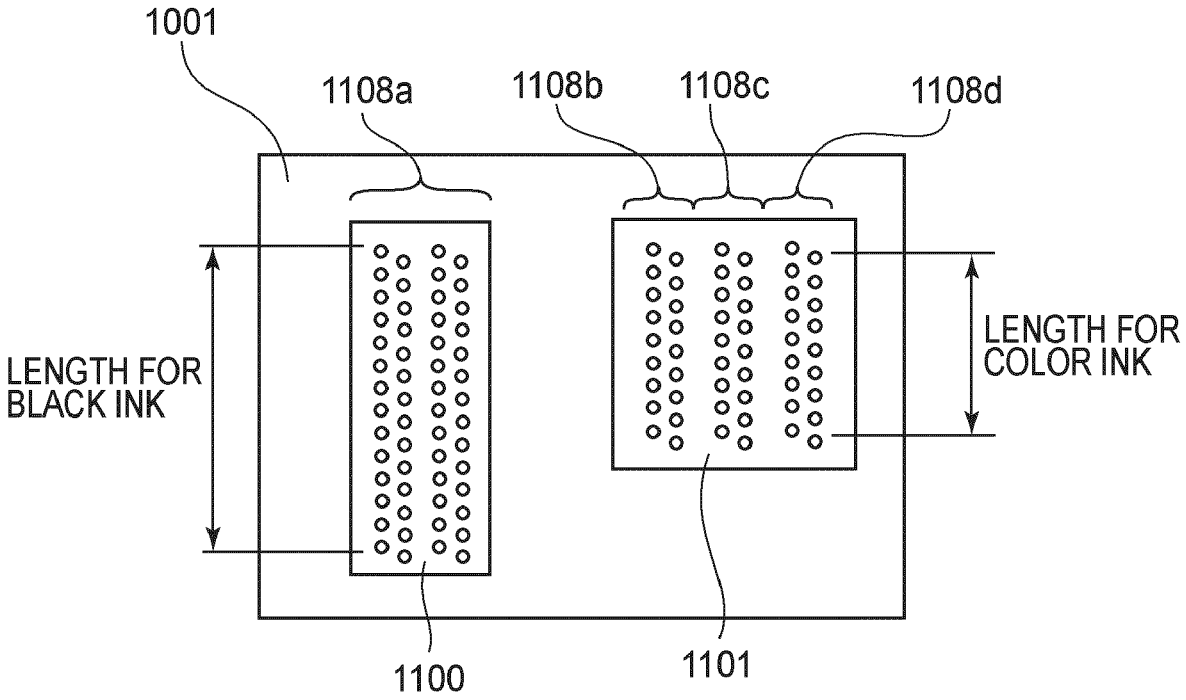
FIG. 4 is a plan view schematically showing an arrangement of a recording element substrate and ejection outlet arrays of the recording head as seen from a recording material side.

FIG. 4 is a schematic view of ejection outlet arrays provided on the first recording element substrate 1100 and the second recording element substrate 1101 of the recording head shown in FIG. 3, as seen from a recording material side.

An ejection outlet array 1108*a* provided on the first recording element substrate 1100 is provided with ejection outlets for ejecting a black ink and ejection outlets for ejecting inks of yellow, magenta and cyan so that the number of the ejection outlets for black is larger than that of the ejection outlets for yellow, magenta and cyan, in order to effect monochromatic recording at a relatively high speed. In this embodiment, the number of the ejection outlets for black is about 1.5 times that of the ejection outlets for yellow, magenta and cyan on the basis of a length of the ejection outlet array and is about 2 times that of the ejection outlets for yellow, magenta and cyan on the basis of the number of the ejection outlet arrays. In combination of these, the ejection outlet array 1108*a* is provided with the ejection outlets for black in the number about 3 times that of the ejection outlets for yellow, magenta and cyan. Therefore, in the case of single color recording of black, compared with the case of color recording of yellow, magenta and cyan, it is possible to effect recording at a speed 3 times higher than that in the case of the color recording even when the same frequency of ejection of ink from each ejection outlet is employed.

Figure 5:
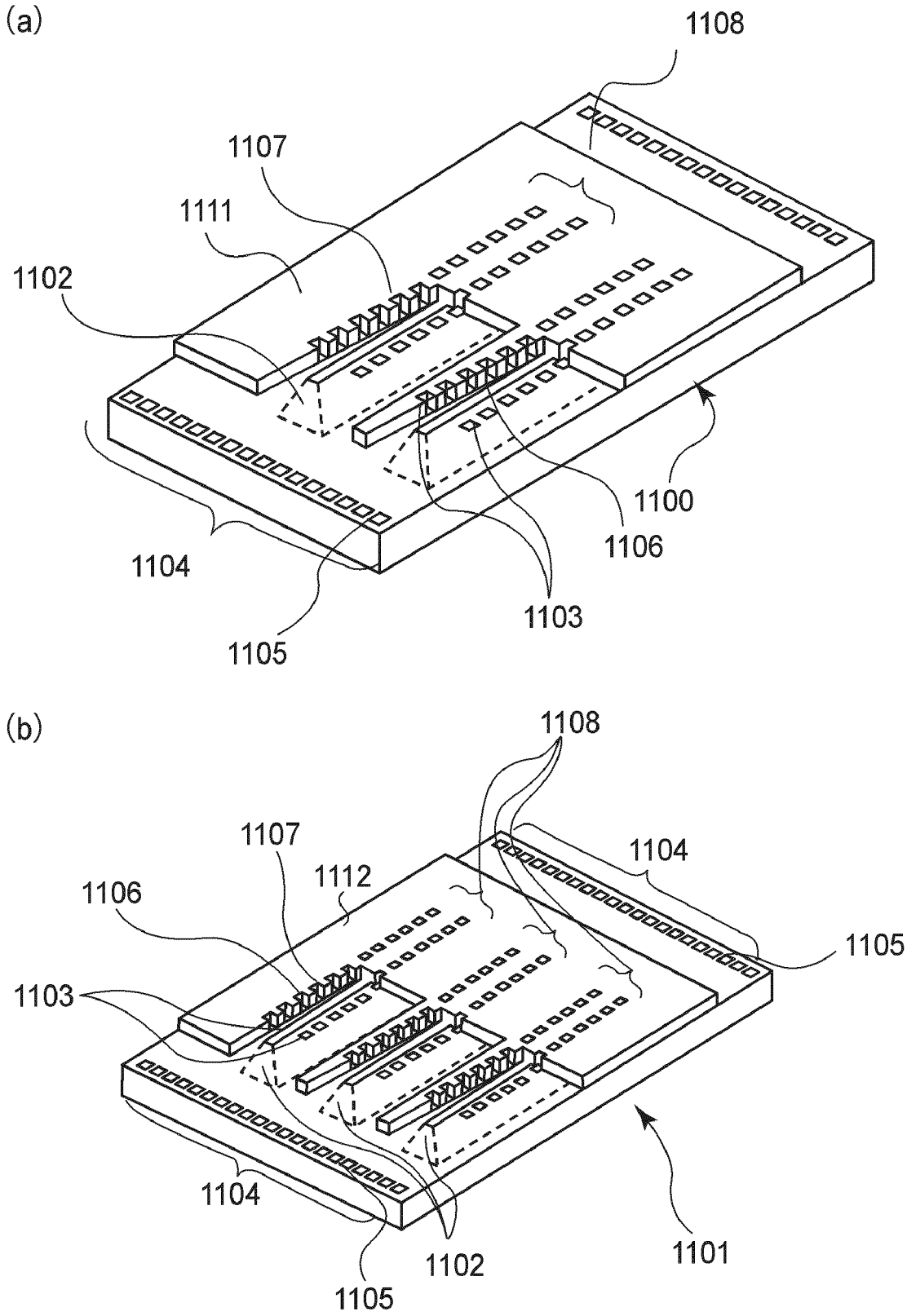
FIGS. 5(*a*) and 5(*b*) are partially cut away perspective views of a first recording element substrate and a second recording element substrate, respectively.

FIG. 5(*a*) is a partly exploded perspective view of the first recording element substrate 1100 for ejecting the black ink shown in FIG. 4. The first recording element substrate 1100 is provided with two parallel supply ports 1102 each consisting of an elongated hole-like through hole formed on an Si substrate in a thickness of, e.g., 0.5-1 mm by a processing method such as anisotropic etching utilizing crystal orientation of Si or sand blast. On both sides of each of the supply ports 1102, electrothermal transducer elements 1103 are arranged in a line for each side in a staggered fashion. Further, the electrothermal transducer elements 1103 and an electric wiring portion of Al or the like for supplying electric power to the electrothermal transducer elements 1103 are formed by, e.g., a film-forming method. Further, an electrode portion 1104 for supplying electric power to the electric wiring portion is disposed outside both end sides of the electrothermal transducer elements 1103 and is provided with bumps 1105 formed at Au or the like. On the first recording element substrate 1100, an ejection outlet plate 1111 having the ejection outlet array 1108 is provided. On the ejection outlet plate 1111, ink flow passage walls 1106 and ejection outlets 1107 for defining ink flow passages are formed correspondingly to the electrothermal transducer elements 1103 by, e.g., photolithography using a resinous material. Therefore, the ink supplied from the supply port 1102 is ejected by bubbles generated on the electrothermal transducer element 1103 since the ejection outlets 1107 are provided oppositely to the electrothermal transducer elements 1103.

FIG. 5(*b*) is a partly exploded perspective view of the second recording element substrate 1101 for ejecting the inks of yellow, magenta and cyan shown in FIG. 4. The second recording element substrate 1101 is configured to eject three color inks of yellow, magenta and cyan. On the second recording element substrate 1101, three parallel supply ports 1102 are disposed and on both sides of each of the supply ports 1102, electrothermal transducer elements 1103 and ejection outlets 1107 are formed. Further, the second recording element substrate 1101 is, similarly as in the case of the first recording element substrate 1100, provided with supply ports, an electric wiring portion, and an electrode portion. Further, on the second recording element substrate 1101, similarly as in the case of the first recording element substrate 1100, an ejection outlet plate 1112 provided with ink flow passages and ejection outlets is formed of a resinous material by lithography. Further, similarly as in the case of the first recording element substrate 1100, at the electrode portion 1104 of the second recording element substrate 1101 for supplying electric power to the electric wiring portion, bumps 1105 are formed of Au or the like.

Referring again to FIG. 3, the first plate 1200 as the supporting member is formed of an alumina ($Al_2O_3$) material in a thickness of, e.g., 0.5-10 mm. The material for the first plate 1200 is not limited to the alumina material but may preferably be a material which has a rate of linear expansion equal to that of the material for the recording element substrate 1100 and a thermal conductivity equal to or more than that of the material for the recording element substrate 1100. For example, the material for the first plate 1200 may be any of silicon (Si), aluminum nitride (AlN), zirconia, silicon nitride ($Si_3N_4$), silicon carbide (SiC), molybdenum (Mo), and tungsten (W). On the first plate 1200, the supply ports 1201 for supplying the block ink to the first recording element substrate 1100 and the supply ports for supplying the color inks of cyan, magenta and yellow to the second recording element substrate 1101 are formed. The first recording element substrate 1100 and the second recording element substrate 1101 are adhesively fixed to the first plate 1200 with positional accuracy.

The electric wiring tape 1300 is electrically connected to each of the first recording element substrate 1100 and the second recording element substrate 1101. The electric wiring tape 1300 includes a plurality of openings for incorporating the respective recording element substrates 1100 and 1101 and electrode terminals 1302 corresponding to the electrode portions of the respective recording element substrates 1100 and 1101. At an end portion of the electric wiring tape 1300, an electrode terminal portion 1303 to be electrically connected to an electric contact substrate 2200 having external signal input terminals for receiving an electric signal from the recording apparatus is provided. The electrode terminals 1302 and the electrode terminal portion 1303 are formed in a continuous wiring pattern of a copper foil.

The second plate 1400 is a single plate-like member having a thickness of, e.g., 0.5-1 mm and is formed of a material such as ceramics (e.g., alumina ($Al_2O_3$) or the like), a metallic material (e.g., Al or SUS), or a resinous material. The second plate 1400 is adhesively bonded to the first plate 1200 so that the first recording element substrate 1100 and the second recording element substrate 1101 are electrically connected to the electric wiring tape 1300 in a planar manner. Further, the electric wiring tape 1300 is bent at a side surface of the first plate 1200 after being adhesively bonded to the second plate 1400 at a back surface thereof.

Embodiment

In this embodiment, specific shapes of the first recording element substrate 1100 and the first plate 1200 will be described with reference to FIGS. 6(*a*) to 6(*c*).

Figure 14:
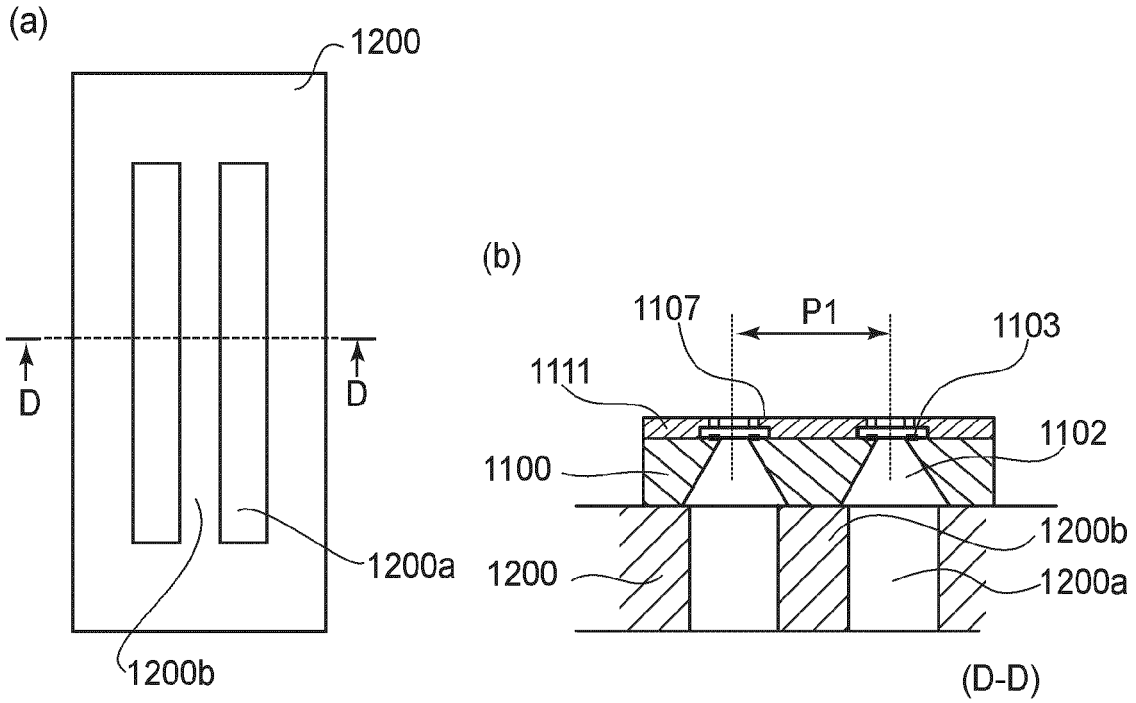
FIGS. 14(*a*) and 14(*b*) are schematic views showing states of a recording element substrate and a first plate of a conventional recording head.

First, shapes of the first recording element substrate 1100 and the first plate 1200 of a conventional ink jet recording head will be described with reference to FIGS. 14(*a*) and 14(*b*) and FIGS. 15(*a*) and 15(*b*). FIG. 14(*a*) shows a shape of the conventional first plate 1200 as seen from the recording material side. FIG. 14(*b*) is a sectional view showing structures of the first plate 1200 and the first recording element substrate 1100 taken along a D-D line shown in FIG. 14(*a*). In this case, a pitch P1 between two supply ports 1102 is ensured to some extent, so that a thickness of a partition wall 1200*b* can be sufficiently ensured correspondingly to the pitch P1. For this reason, the partition wall 1200*b* can be formed between adjacent supply flow passages 1200*a* of the first plate 1200. Heat accumulated at a portion between two supply ports 1102 of the first recording element substrate 1100 is released through the partition wall 1200*b*.

Figure 15:
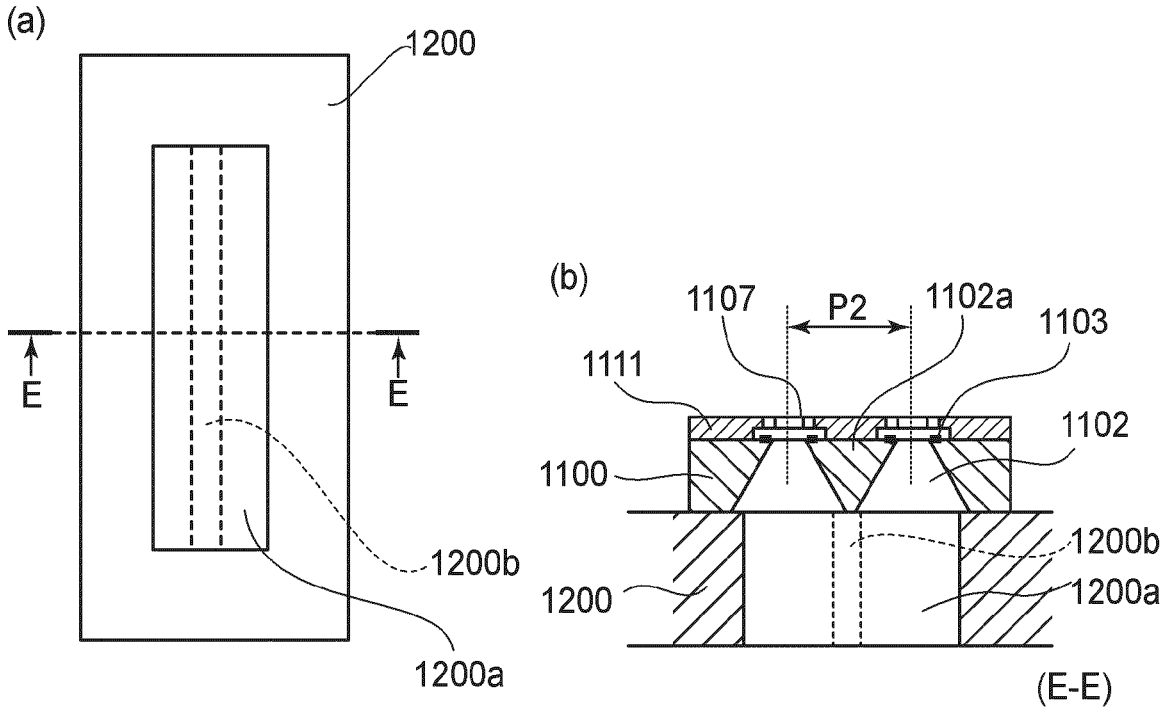
FIGS. 15(*a*) and 15(*b*) are schematic views showing states of a recording element substrate and a first plate of a conventional recording head.
Figure 16:
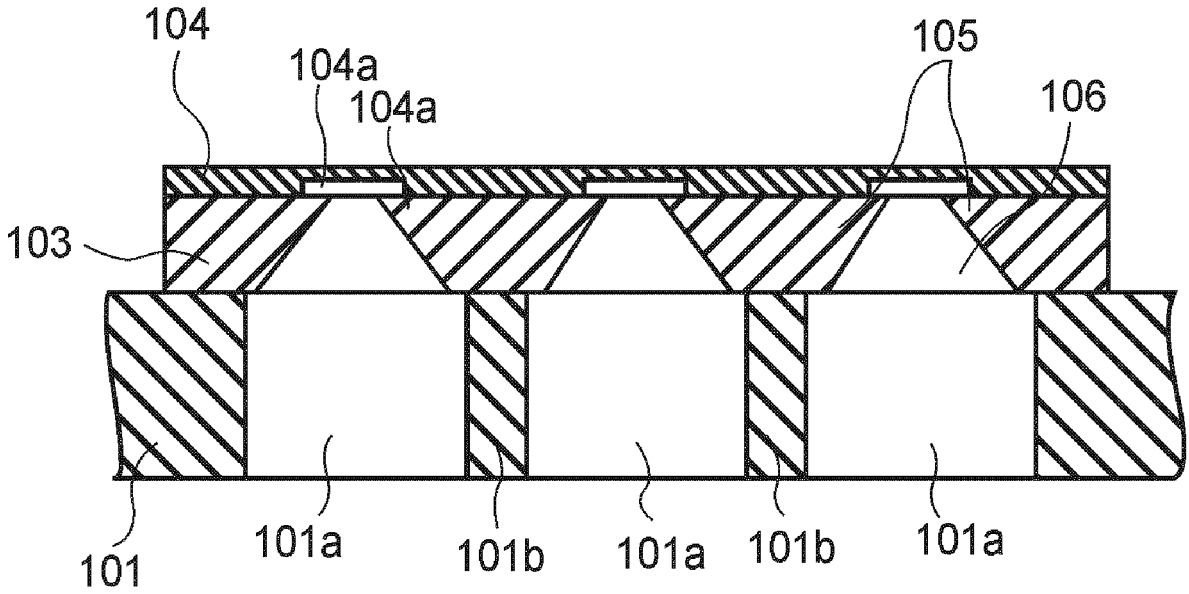
FIG. 16 is a sectional view showing a state in which a recording element substrate is mounted on a supporting member in a conventional ink jet recording head.
Figure 17:
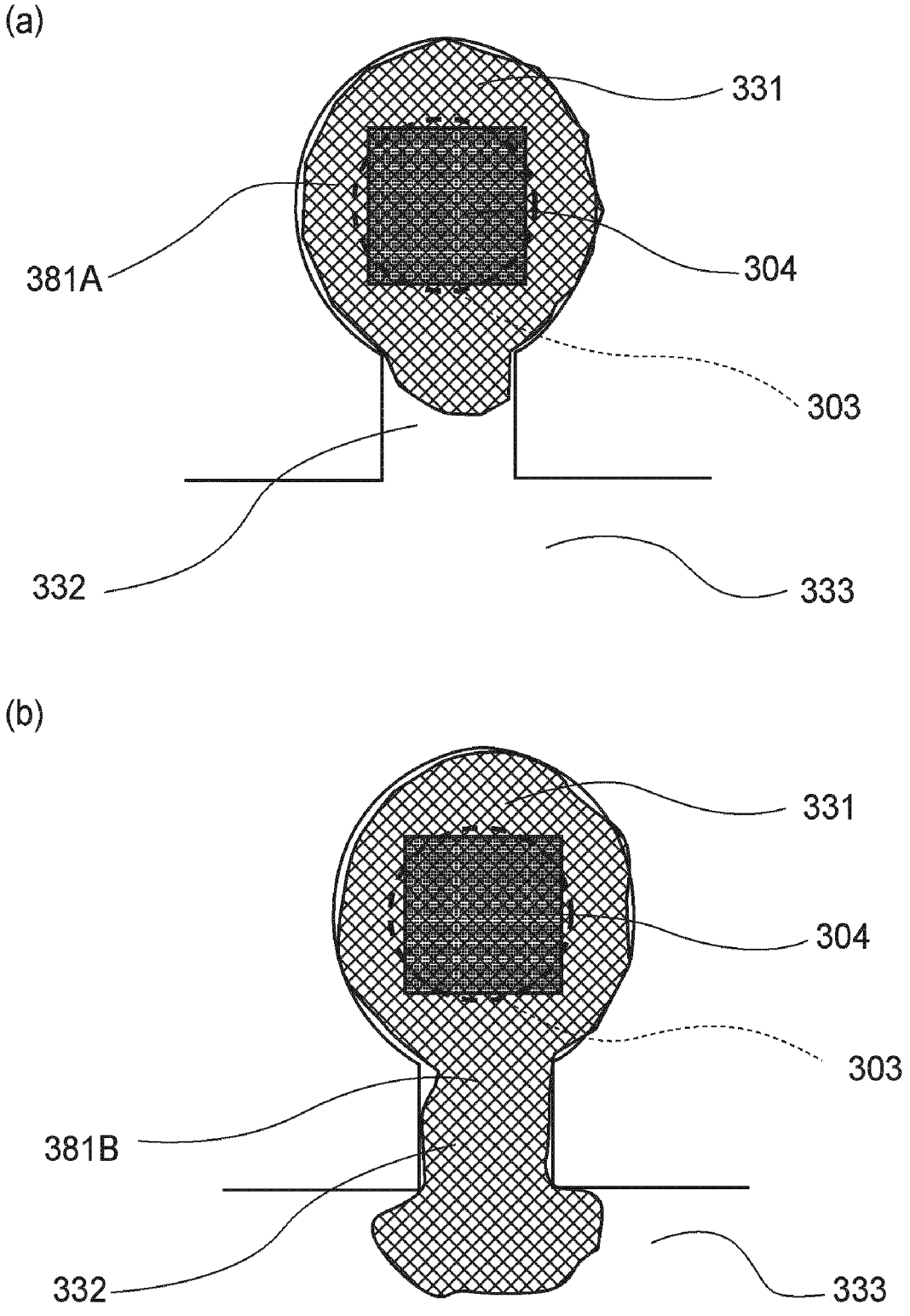
FIGS. 17(*a*) and 17(*b*) are plan views schematically showing maximum bubble generation states at normal temperature and high temperature, respectively.

FIG. 15(*a*) is a plan view showing a shape of the first plate 1200 for supporting substrate 1100 decreased in pitch between the two supply ports 1102 in order to reduce a production cost, as seen from the recording material side. FIG. 15(*b*) is a sectional view showing a positional relationship between supply flow passages 1200*a* of the first plate 1200 and the supply ports 1102 of the first recording element substrate 1100, taken along an E-E line shown in FIG. 15(*a*). In the case of using the first recording element substrate 1100 having such a constitution, a pitch P2 between the two supply ports 1102 is small, so that a thickness of a partition wall 1200*b* corresponding to the pitch P2 is such that it is difficult to form the partition wall 1200*b*. Therefore, the partition wall 1200*b* cannot be formed between the two supply flow passages 1200*a*, so that it is difficult to release heat accumulated at a portion between the two supply ports 1102 during a continuous recording operation.

Figure 6:
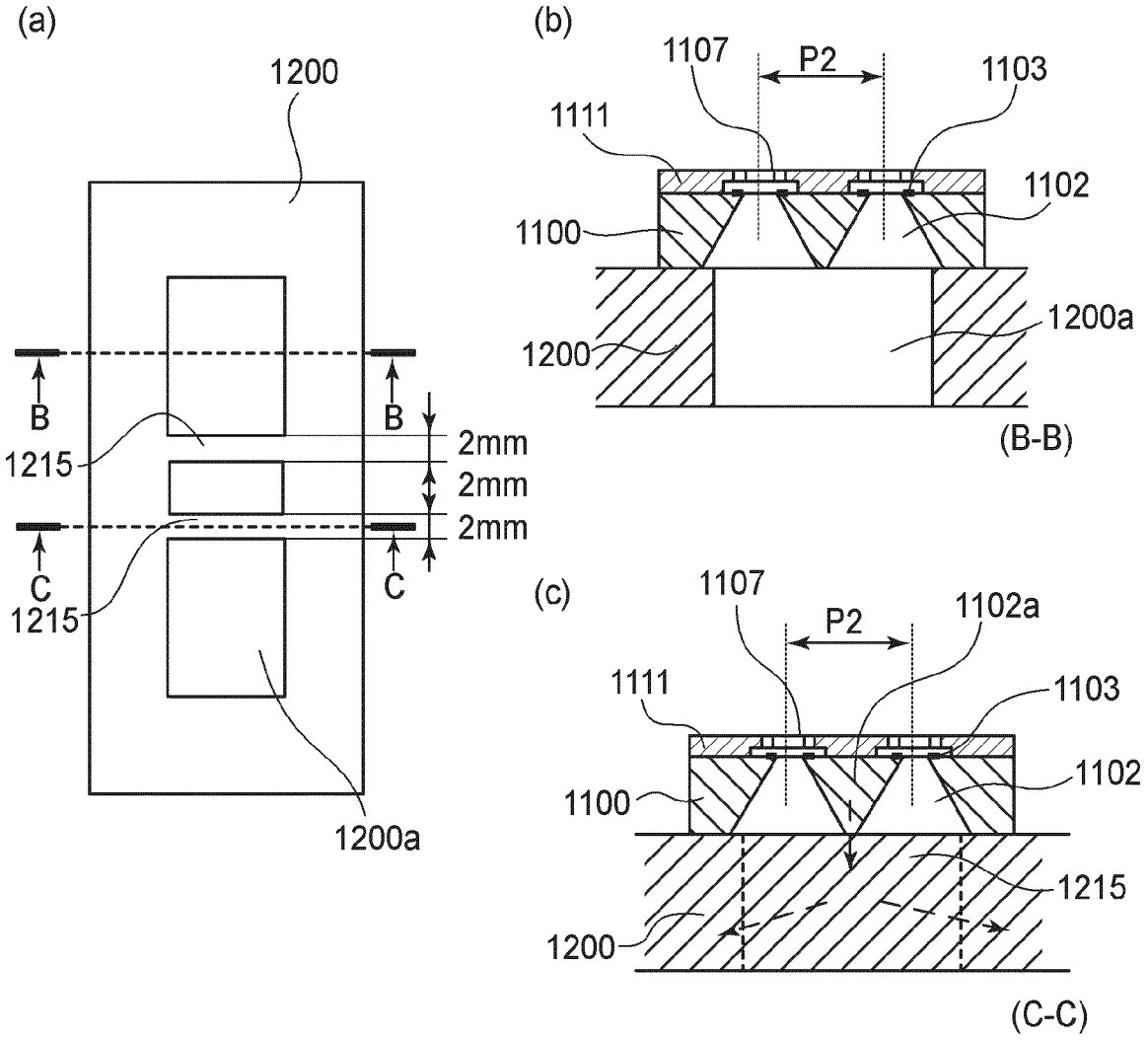
FIGS. 6(*a*) to 6(*c*) are schematic views showing states of the recording element substrate and a first plate in the recording head of the embodiment.

FIG. 6(*a*) is a plan view showing a shape of the first plate 1200 in this embodiment as seen from the recording material side. In this embodiment, each of beams 1215 has a width W of 2 mm and the beams 1215 are spaced 2 mm apart. Further, each of the beams 1215 is disposed within a range of 2.5 W from a center of the supply flow passage 1200*a* with respect to a longitudinal direction of the supply flow passage 1200*a*, i.e., the beams 1215 are disposed in a range of 5 mm+5 mm=10 mm with the center of the supply flow passage 1200*a* as a center of the range. FIG. 6(*b*) is a sectional view showing a positional relationship between the first plate 1200 and the first recording element substrate 1100, taken along a B-B line shown in FIG. 6(*a*). FIG. 6(*c*) is a sectional view showing a positional relationship between the first plate 1200 and the first recording element substrate 1100, taken along a C-C line shown in FIG. 6(*a*).

As shown in FIG. 6(*b*), to the first recording element substrate 1100, two supply ports 1102 are provided adjacent to each other. The supply flow passage 1200*a* of the first plate 1200 communicates with the respective supply ports 1102 and is opened to the two supply ports 1102. Further, the supply flow passage 1200*a* penetrates through the first plate 1200 in a thickness direction of the first plate 1200. Further, as shown in FIG. 6(*c*), each of the beams 1215 is provided, so as to extend over the two supply ports 1102, in the entire thickness of the first plate 1200.

In this embodiment, the pitch P2 is relatively small, so that a thickness of a corresponding partition wall is such that it is difficult to form the partition wall as a constituent element of the first plate 1200. Therefore, in this embodiment, the partition wall cannot be formed in the supply flow passage 1200*a*. However, as shown in FIGS. 6(*a*) and 6(*c*), the first plate 1200 in this embodiment is provided with the two beams 1215 each crossing the supply flow passage 1200*a* in the widthwise direction at the central portion of the supply flow passage 1200*a* with respect to the longitudinal direction of the supply flow passage 1200*a*. By providing these beams 1215, heat accumulated at a portion 1102*a* between the two supply ports 1102 during a continuous recording operation can be diffused through the first plate 1200 as shown by a broken line of arrows indicated in FIG. 6(*c*).

Comparative Embodiment

Next, a temperature characteristic of a recording head during ink ejection in this Comparative Embodiment will be described with reference to FIGS. 7(*a*) to 7(*c*). For convenience, in this Comparative Embodiment, members identical to those in Embodiment described above are represented by the same reference numerals or symbols and omitted from redundant explanation.

Figure 7:
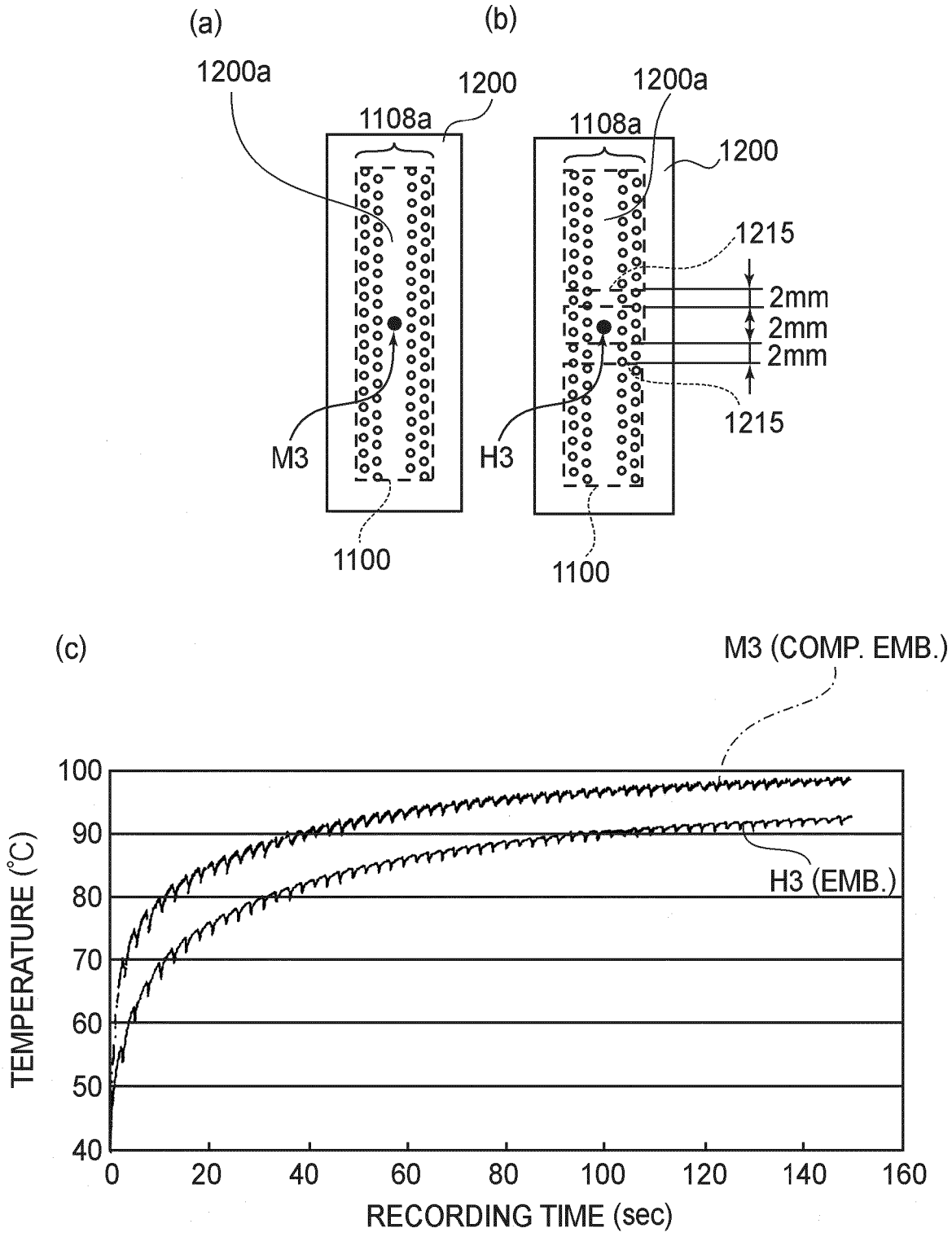
FIGS. 7(*a*) to 7(*c*) are schematic views for illustrating a temperature characteristic of a recording head in Comparative Embodiment.

FIG. 7(*a*) is a plan view showing a temperature measuring point of the recording head in this Comparative Embodiment in which a first plate provided with no beam in a supply flow passage is used. FIG. 7(*b*) is a plan view showing a temperature measuring point of the recording head in the above-described Embodiment of the present invention in which the first plate provided with the two beams with a minimum spacing between the two beams at the longitudinal central portion of the supply flow passage as shown in FIGS. 6(*a*) to 6(*c*) is used. As described above, the spacing between the two beams in the above-described Embodiment is set at 2 mm. FIG. 7(*c*) is a graph showing a relationship between a temperature measured at the temperature measuring points shown in FIGS. 7(*a*) and 7(*b*) and a recording time.

In FIG. 7(*a*), a temperature measuring point M3 is a point which is located at a center between the two ejection outlet arrays 1108*a* each including two ejection outlet array portions and is a center position of the supply flow passage 1200*a* with respect to the longitudinal direction of the supply flow passage 1200*a*. In FIG. 7(*b*), a temperature measuring point H3 in the above-described Embodiment of the present invention is a point corresponding to the temperature measuring point M3 in this Comparative Embodiment.

FIG. 7(*c*) shows a result of measurement of temperatures at the above-described two temperature measuring points M3 and H3 when continuous ejection of ink was performed by using the recording heads shown in FIGS. 7(*a*) and 7(*b*). A continuous ejection condition was such that all the ejection outlets were subjected to continuous recording for 2 minutes and 30 seconds at a frequency of 15 kHz. As a result, the temperature at the temperature measuring point H3 is lower than the temperature at the temperature measuring point M3 by about 5 to 7° C. by the heat release through the beams 1215. Therefore, in the recording head of the Embodiment of the present invention, the heat of the recording element substrate is further released to the first plate side. With respect to an ink refilling performance, the same performance was exhibited in both of the Embodiment and the Comparative Embodiment.

In the Embodiment of the present invention, by providing the beams in the supply flow passage of the first plate, even in the case of ejecting ink droplets in the same amount per unit time, it was possible to suppress temperature rise of the recording element substrate compared with the case of the conventional recording head. Therefore, a frequency of lowering the ejection frequency of the recording head or a frequency of ensuring a rest period during the recording operation is lowered, so that the recording speed can be increased.

First Reference Embodiment

In the above-described Comparative Embodiment, the supply flow passage of the first plate is not provided with the beam. In First Reference Embodiment, the supply flow passage of the first plate is provided with two beams equidistantly disposed with respect to a longitudinal direction of the supply flow passage. Comparison between this First Reference Embodiment and the above-described Embodiment of the present invention will be described with reference to FIGS. 8(*a*) and 8(*b*).

For convenience, in this First Reference Embodiment, members identical to those in Embodiment described above are represented by the same reference numerals or symbols and omitted from redundant explanation.

Figure 8:
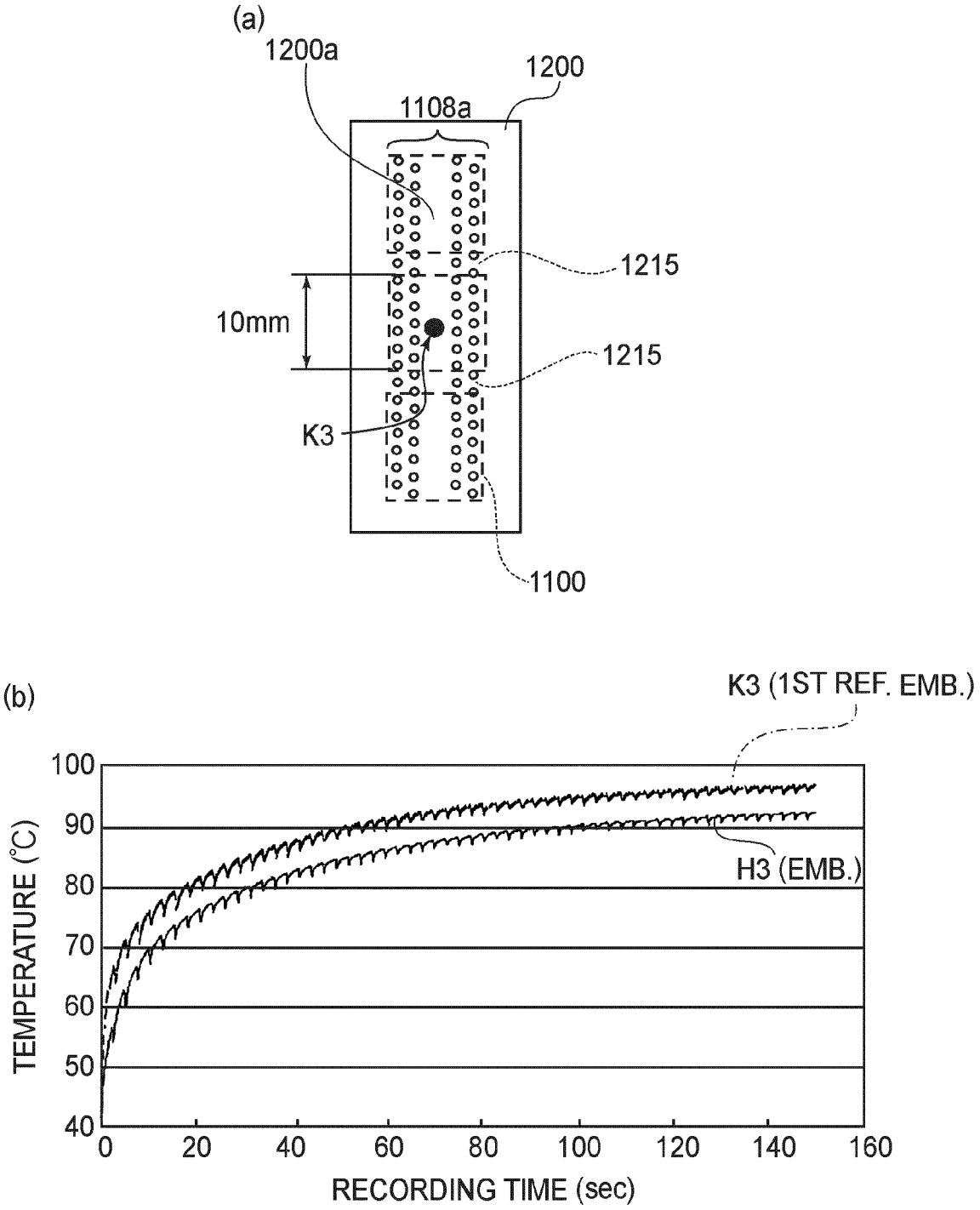
FIGS. 8(*a*) and 8(*b*) are schematic views for illustrating a temperature characteristic of a recording head in Reference Embodiment 1.

FIG. 8(*a*) is a plan view showing a temperature measuring point of the recording head in this First Reference Embodiment in which a first plate provided with two beams 1215 in a supply flow passage 1200 so that the two beams are equidistantly spaced from a center of the supply flow passage 1200*a* with respect to a longitudinal direction of the supply flow passage 1200*a* is used. In this First Reference Embodiment, a spacing between the equidistantly disposed two beams 1215 is set at 10 mm and a width of each of the two beams 1215 is set at 2 mm. FIG. 8(*b*) is a graph showing a relationship between a temperature measured at the temperature measuring points shown in FIGS. 8(*a*) and 7(*b*) and a recording time.

In FIG. 8(*a*), a temperature measuring point K3 is a point which is located at a center between the two ejection outlet arrays 1108*a* each including two ejection outlet array portions and is a center position of the supply flow passage 1200*a* with respect to the longitudinal direction of the supply flow passage 1200*a*.

FIG. 8(*b*) shows a result of measurement of temperatures at the above-described two temperature measuring points K3 and H3 when continuous ejection of ink was performed by using the recording heads shown in FIGS. 8(*a*) and 7(*b*). A continuous ejection condition was such that all the ejection outlets were subjected to continuous recording for 2 minutes and 30 seconds at a frequency of 15 kHz. As a result, the temperature at the temperature measuring point H3 is lower than the temperature at the temperature measuring point K3 by about 1 to 2° C. although the same number of the beams 1215 is employed. Therefore, in the recording head of the Embodiment of the present invention, the heat of the recording element substrate is more effectively released to the first plate side compared with this First Reference Embodiment. With respect to an ink refilling performance, the same performance was exhibited in both of the Embodiment and this First Reference Embodiment.

In the Embodiment of the present invention, by providing the beams in the supply flow passage of the first plate so that the spacing between the beams is minimized with respect to the longitudinal direction of the supply flow passage, even in the case of ejecting ink droplets in the same amount per unit time, it was possible to suppress temperature rise of the recording element substrate compared with the case of the reference recording head. Therefore, a frequency of lowering the ejection frequency of the recording head or a frequency of ensuring a rest period during the recording operation is lowered, so that the recording speed can be increased.

Second Reference Embodiment

In the First Reference Embodiment, the supply flow passage of the first plate is provided with the two beams. In Second Reference Embodiment, the supply flow passage of the first plate is provided with a single wider beam disposed at a center of the supply flow passage with respect to a longitudinal direction of the supply flow passage. Comparison between this Second Reference Embodiment and the above-described Embodiment of the present invention will be described with reference to FIGS. 9(*a*) and 9(*b*).

Figure 9:
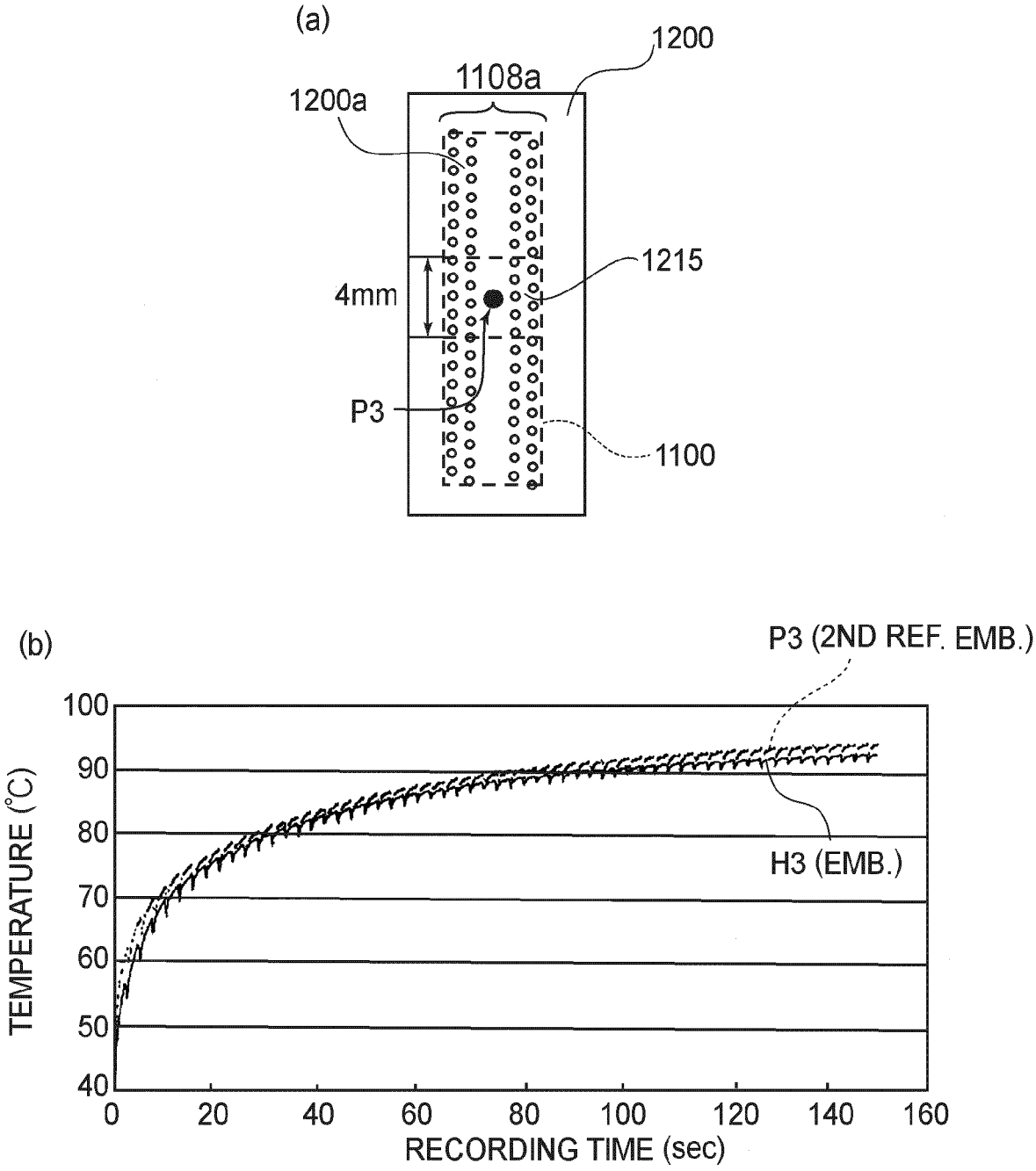
FIGS. 9(*a*) and 9(*b*) are schematic views for illustrating a temperature characteristic of a recording head in Reference Embodiment 2.

FIG. 9(*a*) is a plan view showing a temperature measuring point of the recording head in this Second Reference Embodiment.

FIG. 9(*b*) is a graph showing a relationship between a temperature measured at the temperature measuring points shown in FIGS. 9(*a*) and 7(*b*) and a recording time.

As shown in FIG. 9(*a*), the recording head in this Second Reference Embodiment is provided with the first plate 1200 having the supply flow passage 1200*a* to which a single beam 1215 having a width of, e.g., 4 mm with respect to the longitudinal direction of the supply flow passage 1200*a* is provided at a longitudinal central portion of the supply flow passage 1200*a*.

A temperature measuring point P3 is a point which is located at a center between the two ejection outlet arrays 1108*a* each including two ejection outlet array portions and is the center position of the supply flow passage 1200*a* with respect to the longitudinal direction of the supply flow passage 1200*a*.

FIG. 9(*b*) shows a result of measurement of temperatures at the above-described two temperature measuring points P3 and H3 when continuous ejection of ink was performed by using the recording heads shown in FIGS. 9(*a*) and 7(*b*). A continuous ejection condition was such that all the ejection outlets were subjected to continuous recording for 2 minutes and 30 seconds at a frequency of 15 kHz.

As also described in First Reference Embodiment, with respect to the temperature at the temperature measuring point H3, by the heat release through the two beams, the heat of the recording element substrate is released to the first plate side. Also with respect to the temperature at the temperature measuring point P3, the temperature characteristic substantially similar to the temperature characteristic at the temperature measuring point H3 is obtained although the single wider beam is employed. This means that the heat release is saturated at a temperature in the beam portion, thus showing the fact that a heat releasing effect is not increased even when the beam width is increased.

However, with respect to the ink refilling performance, the constitution of the recording head of the above-described Embodiment of the present invention in which the spacing between the two beams is minimized at the longitudinal central portion of the supply flow passage is superior to the constitution of the recording head of this Second Reference Embodiment in which the single beam increased in width is provided. This means that the ink refilling performance is lowered in the case where the beam width is increased.

Therefore, according to the Embodiment of the present invention, by minimizing the spacing between the two beams 1215 at the longitudinal central portion of the supply flow passage 1200*a*, it is possible to suppress the increase in temperature of the recording element substrate. For this reason, in the Embodiment of the present invention, it is possible to eject ink droplets in the same state per unit time without sacrificing the ink refilling performance.

That is, according to the Embodiment of the present invention, it is possible to suppress temperature rise of the recording element substrate compared with the case of the reference recording head. Therefore, a frequency of lowering the ejection frequency of the recording head or a frequency of ensuring a rest period during the recording operation is lowered, so that the recording speed can be further increased.

The evaluation results in the above-described Embodiment, Comparative Embodiment, First Reference Embodiment, and Second Reference Embodiment are shown in Table 1.

TABLE 1

| | EMB. | COMP. EMB. | 1ST REF. EMB. | 2ND REF. EMB. |
|---|---|---|---|---|
| TC*[1] | AA | C | B | A |
| IRC*[2] | A | A | A | B |

*[1]"TC" represents a temperature characteristic.
*[2]"IRC" represents an ink refilling characteristic.

With respect to the temperature characteristic, the temperature characteristic in the Embodiment of the present invention in which the temperature rise is most effectively suppressed is evaluated as "AA" and in decreasing order of the effect, the temperature characteristic is evaluated as "A", "B", and "C". With respect to the ink refilling characteristic, those of the recording heads in Embodiment, Comparative Embodiment and First Reference Embodiment cause substantially no difference, thus being evaluated as "A". However, the ink refilling characteristic of the recording head in Second Reference Embodiment is inferior to those of the recording heads in other embodiments, thus being evaluated as "B".

In the present invention, as the recording method of the ink jet recording head, the bubble jet method using the electrothermal transducer elements for generating thermal energy, particularly of the side shooter type is described as an example but the constitution of the present invention is not limited thereto. For example, the constitution of the present invention is also applicable to ink jet recording heads of other types such as an edge shooter type in which ink is ejected in a direction parallel to the principal surface of the electrothermal transducer elements.

In the present invention, the two beams are provided within the range from the center of the supply flow passage with respect to the longitudinal direction toward both longitudinal end sides, of the supply flow passage by 2.5 W (W: the beam width) for each of the end sides but the present invention is not limited thereto. In view of the above-described ink refilling characteristic, it is also possible to employ a constitution in which three or more beams are provided appropriately.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264558/2007 filed Oct. 10, 2007, which is hereby incorporated by reference herein.

What is claimed is:

1. An ink jet recording head comprising:

a recording element substrate comprising an ejection outlet array consisting of a plurality of arranged ejection outlets for ejecting ink, a plurality of heat generating elements, provided correspondingly to the ejection outlets, for generating thermal energy for ejecting the ink, and a supply port, formed along the ejection outlet array in an elongated hole-like shape, for supplying the ink to the ejection outlets; and a supporting member, having a supply flow passage communicating with the supply port, for supporting said recording element substrate, wherein said supporting member is provided with at least two beams each extending across an opening of the supply flow passage in a widthwise direction of the supply flow passage and having a width W with respect to a longitudinal direction of the supply flow passage, and wherein said at least two beams are disposed within a range from a center of the supply flow passage with respect to the longitudinal direction toward both longitudinal end sides of the supply flow passage by 2.5 W for each of the end sides and are spaced 2 mm or more apart.

2. A head according to claim 1, wherein the supply port includes a plurality of adjacent supply port portions, and wherein the supply flow passage is opened to the adjacent supply port portions.

3. A head according to claim 2, wherein said at least two beams extend over the adjacent supply port portions.

4. A head according to claim 1, wherein the supply flow passage is provided so as to penetrate said supporting member in a thickness direction of said supporting member, and wherein said at least two beams are provided so as to extend in the thickness direction.

5. A recording apparatus for ejecting ink onto a recording material, comprising:

an ink jet recording head according to claim 1.

* * * * *